US010638211B2

(12) United States Patent
Wen et al.

(10) Patent No.: US 10,638,211 B2
(45) Date of Patent: Apr. 28, 2020

(54) IN-EAR HEADPHONE HAVING MMCX SOCKET AND DETACHABLE IN-EAR HEADPHONE ASSEMBLY

(71) Applicant: Transound Electronics Co., Ltd., Dongguan, Guangdong (CN)

(72) Inventors: Tseng-Feng Wen, Dongguan (CN); Weiguo Zeng, Dongguan (CN); Haijuan Wu, Dongguan (CN); Lin Cheng, Dongguan (CN)

(73) Assignee: TRANSOUND ELECTRONICS CO., LTD., Dongguan, Guangdong (CN)

( * ) Notice: Subject to any disclaimer, the term of this patent is extended or adjusted under 35 U.S.C. 154(b) by 75 days.

(21) Appl. No.: 15/972,213

(22) Filed: May 6, 2018

(65) Prior Publication Data

US 2019/0090043 A1 Mar. 21, 2019

(30) Foreign Application Priority Data

Sep. 18, 2017 (CN) ..... 2017 2 1193908 U

(51) Int. Cl.
*H04R 25/00* (2006.01)
*H04R 1/10* (2006.01)

(52) U.S. Cl.
CPC ..... *H04R 1/1016* (2013.01); *H04R 1/1033* (2013.01); *H04R 1/1066* (2013.01); *H04R 2420/07* (2013.01); *H04R 2420/09* (2013.01)

(58) Field of Classification Search
CPC .. H04R 1/1016; H04R 1/1033; H04R 1/1066; H04R 2420/07; H04R 2420/09
USPC ..... 381/380
See application file for complete search history.

(56) References Cited

U.S. PATENT DOCUMENTS

| | | | | |
|---|---|---|---|---|
| 8,654,987 | B2 * | 2/2014 | Palma | H04R 1/1041 381/370 |
| 10,397,682 | B2 * | 8/2019 | Chawan | |
| 2008/0080733 | A1 * | 4/2008 | Mei | H04R 1/1066 381/379 |
| 2011/0007929 | A1 * | 1/2011 | Rabu | H04R 1/1033 381/380 |
| 2011/0019861 | A1 * | 1/2011 | Wolfe | H04R 1/028 381/384 |
| 2011/0170703 | A1 * | 7/2011 | Palma | H04R 1/1041 381/74 |
| 2014/0133688 | A1 * | 5/2014 | Brodsgaard | H04R 1/105 381/379 |
| 2014/0313688 | A1 * | 10/2014 | Colahan | B29C 70/882 361/818 |
| 2016/0234586 | A1 * | 8/2016 | Sugata | H04R 11/02 |
| 2016/0249133 | A1 * | 8/2016 | Sorensen | H04R 1/105 |
| 2017/0295421 | A1 * | 10/2017 | Hung | H04R 1/1016 |

(Continued)

*Primary Examiner* — Khai N. Nguyen
(74) *Attorney, Agent, or Firm* — Leong C. Lei

(57) ABSTRACT

An in-ear headphone having an MMCX socket and a detachable in-ear headphone assembly are provided. The in-ear headphone includes a headphone housing and a speaker assembly disposed in the headphone housing. The headphone housing includes a first housing and a second housing to be connected with each other. The first housing has a first interface portion extending from one end thereof. The second housing has a second interface portion extending from one end thereof. The first interface portion and the second interface portion jointly form an interface.

7 Claims, 6 Drawing Sheets

(56) References Cited

U.S. PATENT DOCUMENTS

| | | | | |
|---|---|---|---|---|
| 2018/0213316 | A1* | 7/2018 | Oishi | H04R 1/1016 |
| 2019/0090043 | A1* | 3/2019 | Wen | H04R 1/1016 |

* cited by examiner

IN-EAR HEADPHONE HAVING MMCX SOCKET AND DETACHABLE IN-EAR HEADPHONE ASSEMBLY

BACKGROUND OF THE INVENTION

1. Field of the Invention

The present invention relates to a headphone, and more particularly to an in-ear headphone having an MMCX socket and a detachable in-ear headphone assembly.

2. Description of the Prior Art

With the development of personal communication equipment, the words of high-definition large screen, high-fidelity audio and so on have made mobile phones, tablet PCs and other electronic products become our portable multimedia smart terminals. More people wear headphones when going out. Portable electronic products can play music for the users to enjoy personal space. A conventional headphone assembly generally includes a headphone cable and a headphone. Most of the conventional headphones and headphone cables are assembled in a non-detachable manner, which limits the versatility and interchangeability of headphones. As a result, the purchase cost and the maintenance and replacement cost of the headphone are high.

Accordingly, the inventor of the present invention has devoted himself based on his many years of practical experiences to solve this problem.

SUMMARY OF THE INVENTION

In order to overcome the drawbacks of the prior all, the primary object of the present invention is to provide an in-ear headphone having an MMCX socket and a detachable in-ear headphone assembly. The pluggable assembly between the headphone and the headphone cable is realized, which enhances the versatility and interchangeability of the headphone.

According to one aspect of the present invention, an in-ear headphone having an MMCX socket is provided. The in-ear headphone comprises a headphone housing and a speaker assembly disposed in the headphone housing. The headphone housing includes a first housing and a second housing to be connected with each other. The first housing has a first interface portion extending from one end thereof. The second housing has a second interface portion extending from one end thereof. The first interface portion and the second interface portion jointly form an interface. The interface is mounted with the MMCX socket used for connection of a pluggable headphone cable. The MMCX socket is connected to the speaker assembly. The first interface portion is provided with positioning protrusions. The MMCX socket has a base and a plug-in terminal disposed in the base. The base has positioning grooves thereon. The MMCX socket is installed in the first interface portion. The positioning grooves are mated with the positioning protrusions respectively so that the MMCX socket is positioned in the first interface portion. The second interface portion is assembled to the first interface portion for positioning the MMCX socket.

According to another aspect of the present invention, a detachable headphone assembly is provided. The detachable headphone assembly comprises a Bluetooth headphone body and the aforesaid in-ear headphone having the MMCX socket. The in-ear headphone is connected to the Bluetooth headphone body. The Bluetooth headphone body has an ear hook. One end of the ear hook is provided with an MMCX plug to be connected to the MMCX socket. The MMCX plug is pluggable and fitted in the MMCX socket.

According to a further aspect of the present invention, a detachable headphone assembly is provided. The detachable headphone assembly comprises two aforesaid in-ear headphones each having the MMCX socket and two headphone cables connected to the two in-ear headphones respectively. One end of each of the headphone cables is provided with an MMCX plug to be connected to the MMCX socket. The MMCX plug is pluggable and fitted in the MMCX socket. The other ends of the two headphone cables are connected to an audio plug.

According to yet another aspect of the present invention, a detachable headphone assembly is provided. The detachable headphone assembly comprises two aforesaid in-ear headphones each having the MMCX socket and two headphone cables connected to the two in-ear headphones respectively. One end of each of the headphone cables is provided with an MMCX plug to be connected to the MMCX socket. The MMCX plug is pluggable and fitted in the MMCX socket. The other ends of the two headphone cables are connected to a Bluetooth control module.

Compared with the prior art, the present invention has obvious advantages and beneficial effects. Specifically, it can be seen from the above technical solution that the in-ear headphone is provided with the MMCX socket to achieve a pluggable connection between the in-ear headphone the headphone cables, thereby enhancing the versatility and interchangeability of the headphone. The same headphone can be widely used in a variety of different types of headphone products, reducing the purchase cost and maintenance cost for headphones. Besides, it adopts the MMCX socket and the MMCX plug to make the plug-in connection convenient, which is beneficial for use.

DETAILED DESCRIPTION OF THE PREFERRED EMBODIMENTS

Embodiments of the present invention will now be described, by way of example only, with reference to the accompanying drawings.

Figure 1:
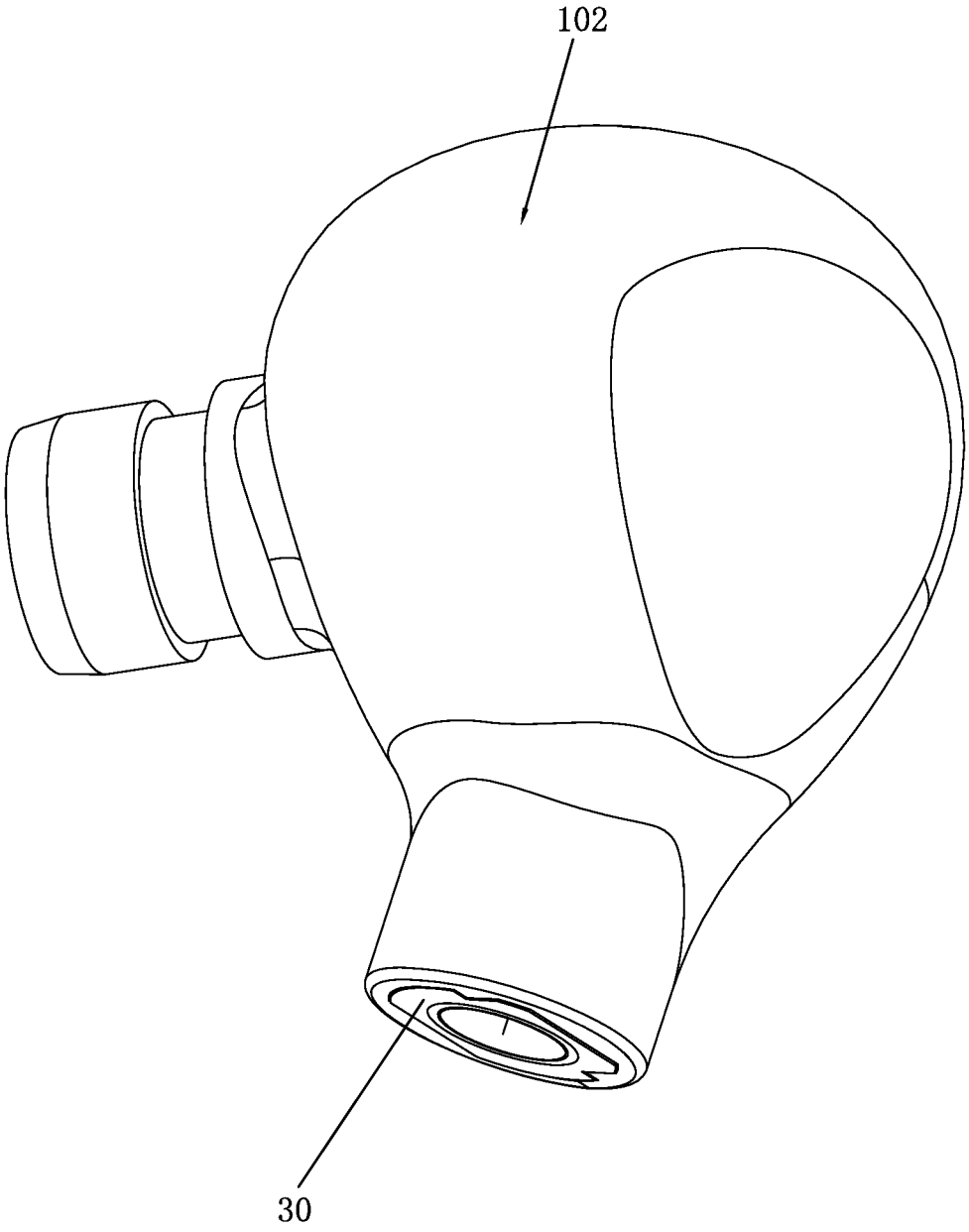
FIG. 1 is a perspective view of the in-ear headphone of the present invention.
Figure 2:
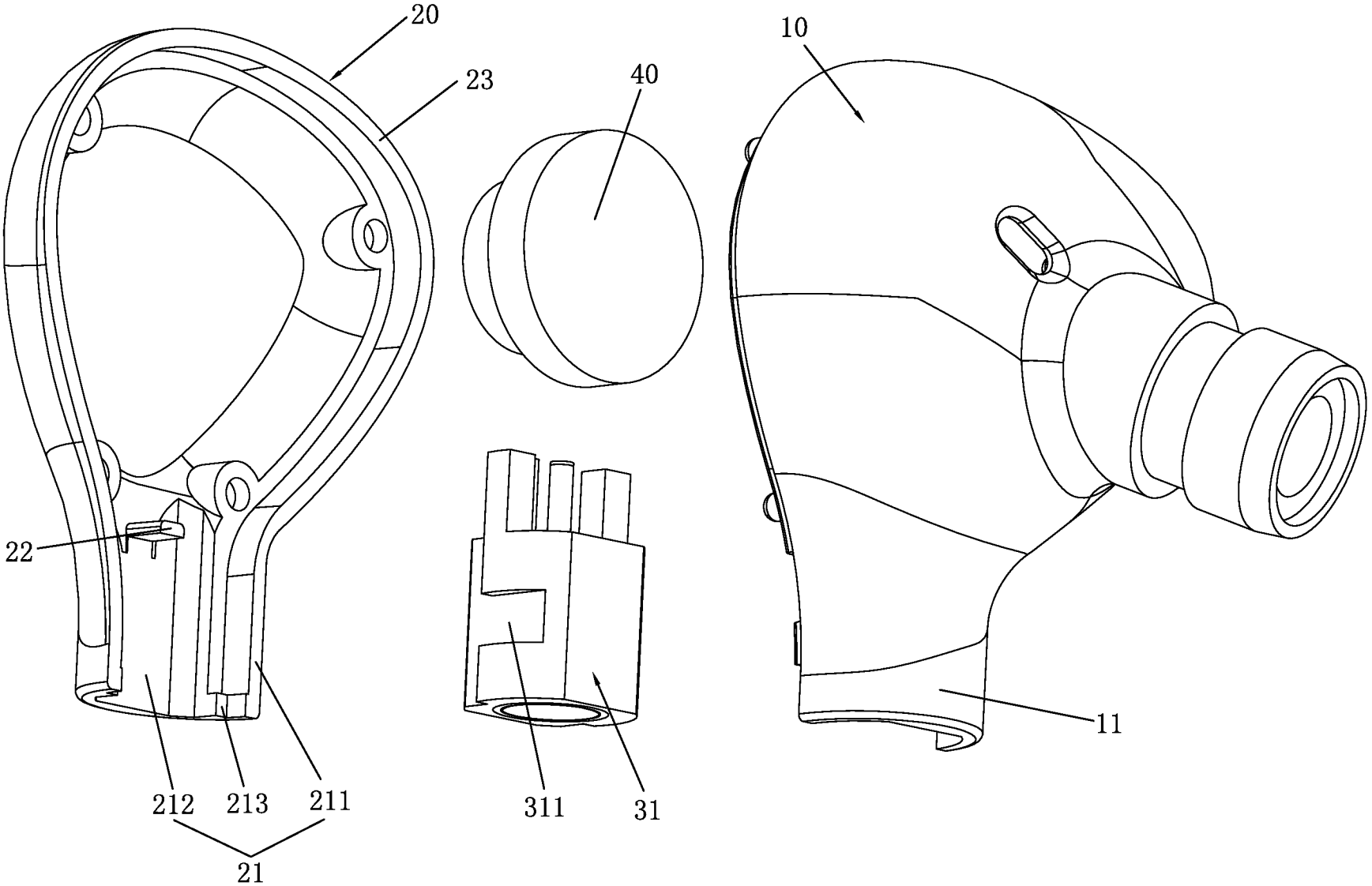
FIG. 2 is an exploded view of the in-ear headphone of the present invention.
Figure 3:
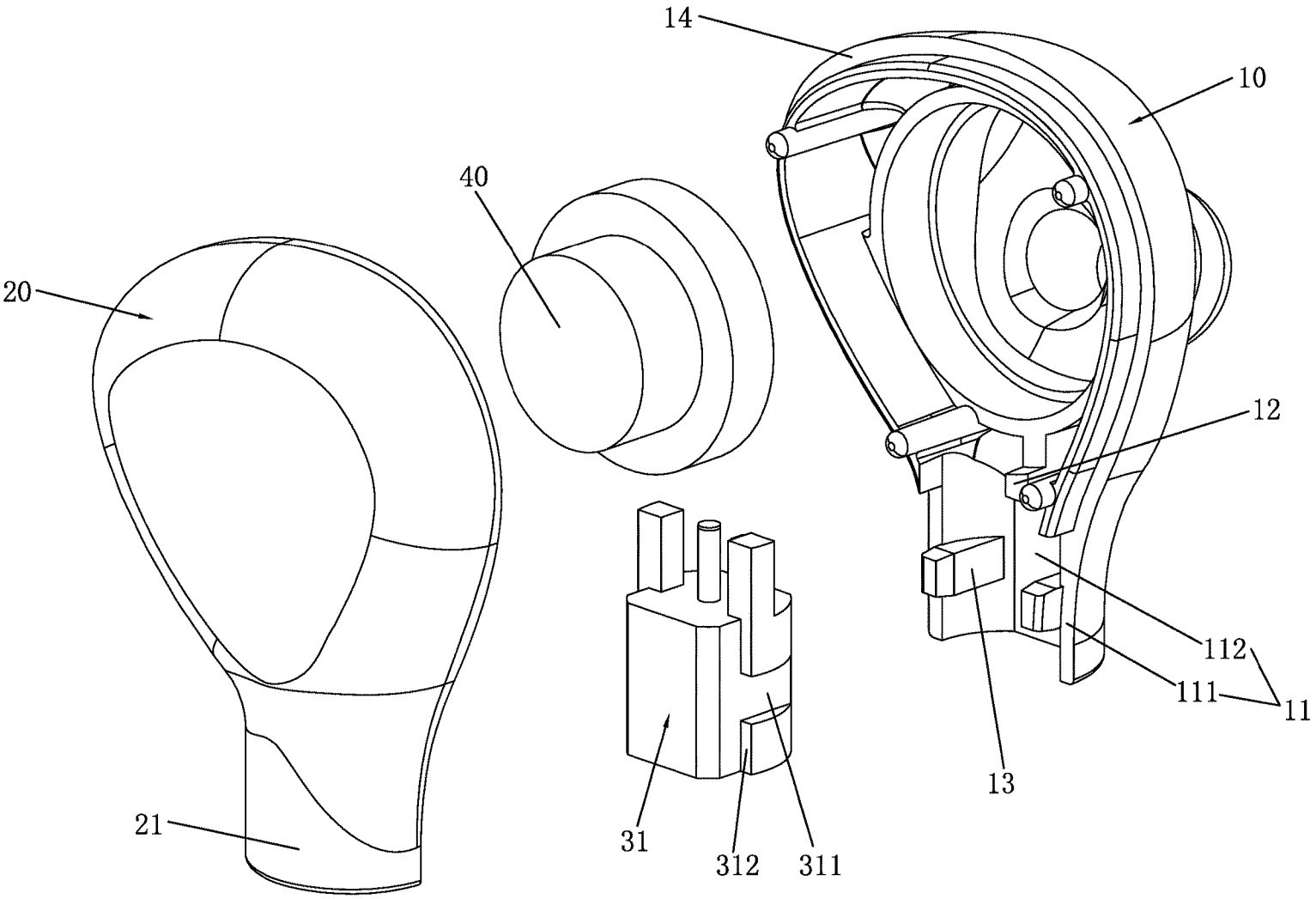
FIG. 3 is another exploded view of the in-ear headphone of the present invention.
Figure 4:
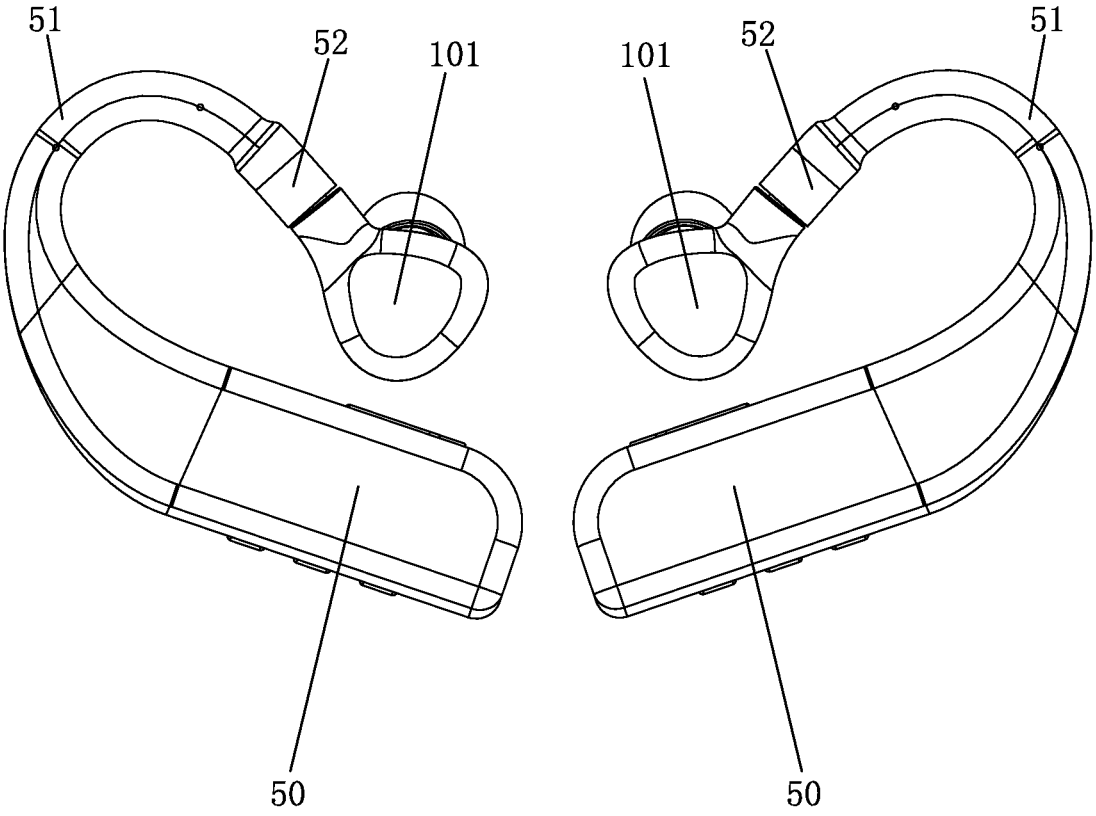
FIG. 4 is a perspective view of a first embodiment of the in-ear headphone assembly of the present invention.
Figure 5:
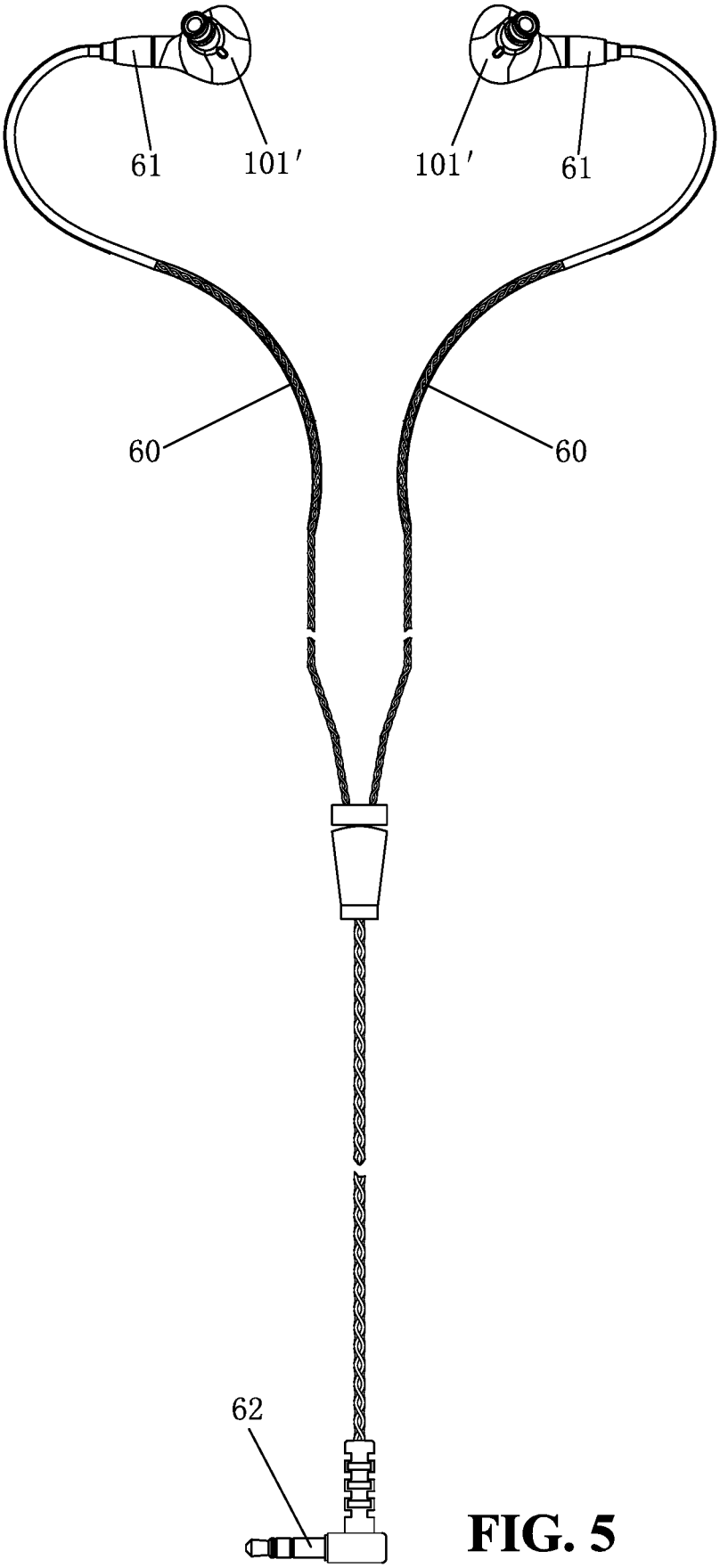
FIG. 5 is a perspective view of a second embodiment of the in-ear headphone assembly of the present invention.
Figure 6:
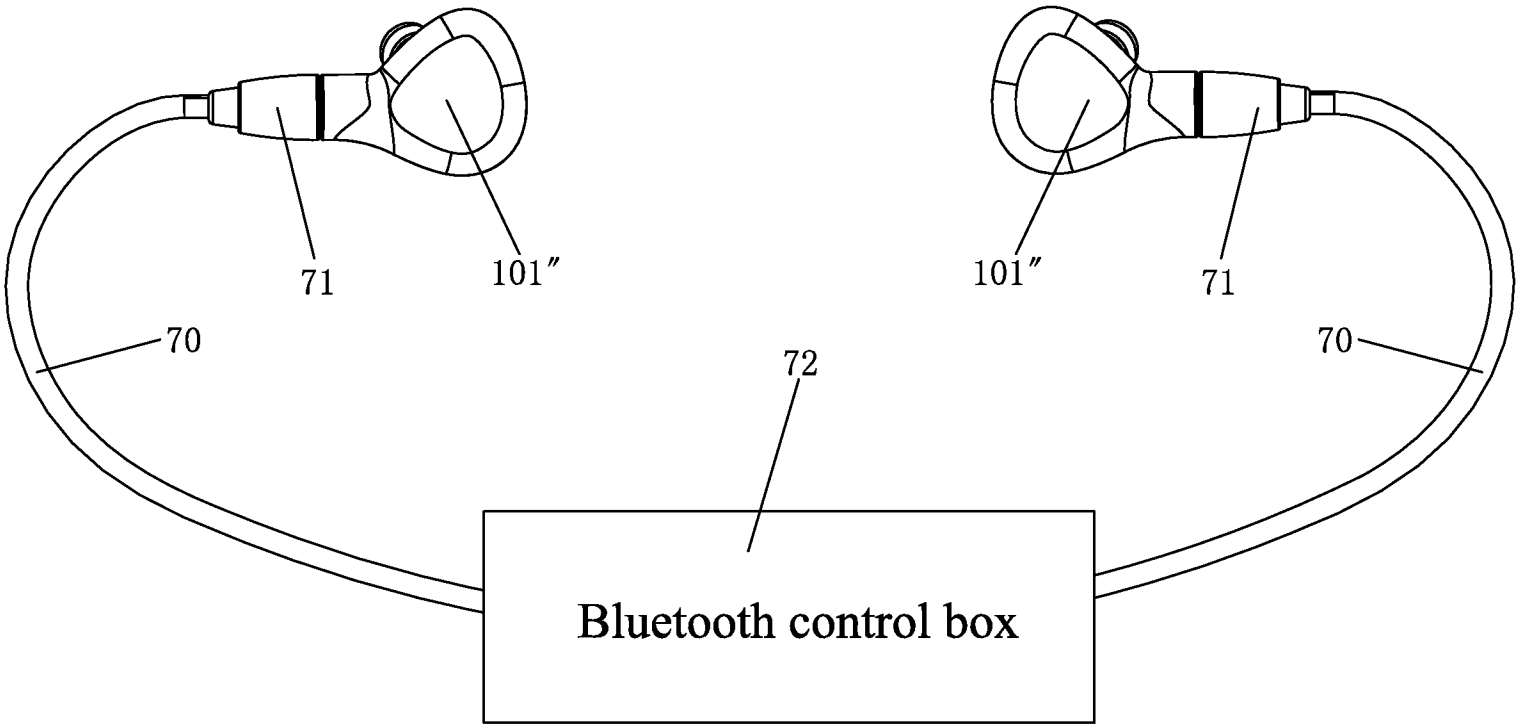
FIG. 6 is a perspective view of a third embodiment of the in-ear headphone assembly of the present invention.

As shown in FIG. 1 to FIG. 6, the present invention discloses an in-ear headphone having an MMCX socket and a detachable in-ear headphone assembly. FIG. 1 to FIG. 3 shows the specific structure of the in-ear headphone of the present invention. FIG. 4 shows a first embodiment of the in-ear headphone assembly of the present invention. FIG. 5 shows a second embodiment of the in-ear headphone assembly of the present invention. FIG. 6 shows a third embodiment of the in-ear headphone assembly of the present invention.

Specifically, as shown in FIG. 1 to FIG. 3, the in-ear headphone having an MMCX socket 30 comprises a headphone housing 102 and a speaker assembly 40 disposed in the headphone housing. The headphone housing includes a first housing 10 and a second housing 20 to be connected with each other. The first housing 10 has a first interface portion 11 extending from one end thereof. The second housing 20 has a second interface portion 21 extending from one end thereof. The first interface portion 11 and the second interface portion 21 jointly form an interface. The interface is mounted with the MMCX socket 30 used for connection of a pluggable headphone cable. The MMCX socket 30 is connected to the speaker assembly 40. The first interface portion 11 is provided with positioning protrusions 13. The MMCX socket 30 has a base 31 and a plug-in terminal disposed in the base 31. The base 31 has positioning grooves 311 thereon. The MMCX socket 30 is installed in the first interface portion 11. The positioning grooves 311 are mated with the positioning protrusions 13 respectively so that the MMCX socket 30 is positioned in the first interface portion 11. The second interface portion 21 is assembled to the first interface portion 11 for positioning the MMCX socket 30.

The first interface portion 11 includes a first semi-annular portion 111. The first semi-annular portion 111 has a first semi-circular mounting trough 112 therein. The positioning protrusions 13 are disposed on two opposite sidewalls in the first semi-annular portion 111 and extend out of an end surface of the first semi-annular portion 111. The positioning grooves 311 are disposed at two sides of the base 31, respectively.

The second interface portion 21 includes a second semi-annular portion 211. The second semi-annular portion 211 has a second semi-circular mounting trough 212 therein. The first semi-annular portion 111 and the second semi-annular portion 211 are attached to each other. The first semi-circular mounting trough 112 and the second semi-circular mounting trough 212 are assembled with each other to form the interface. The end surface of the second semi-annular portion 211 is inwardly recessed with a first positioning step 213. The outer surface of the base 31 is correspondingly provided with a second positioning step 312. The second positioning step 312 extends inwardly beyond the rear end of the base 31. The second positioning step 312 is formed with the positioning grooves 311. The first positioning step 213 is configured to match with the second positioning step 312.

The first housing 10 is further provided with a first limiting portion 12 for limiting the inner end of the MMCX socket 30. The inner end of the base 31 is limited by the first limiting portion 12. Correspondingly, the second housing 20 is further provided with a second limiting portion 22 for limiting the inner end of the MMCX socket 30. The inner end of the base 31 is limited by the second limiting portion 22. The second limiting portion 22 is disposed corresponding to the first limiting portion 12.

The first housing 10 is provided with a first splicing surface 14 for welding. The second housing 20 is provided with a second splicing surface 23 for welding. The first splicing surface 14 and the second splicing surface 23 are spliced to each other by laser welding. The outer surfaces of the first housing 10 and the second housing 20 are formed with a polishing area for the laser welding mark. In addition, in this embodiment, the first housing 10 and the second housing 20 are preferably designed as stainless steel housings. The headphone housing made of stainless steel has better abrasion resistance and texture and is favorable for the metal housing to be polished.

As shown in FIG. 4, in a first embodiment, the detachable headphone assembly comprises a Bluetooth headphone body 50 and the in-ear headphone having the MMCX socket 30. The in-ear headphone is connected to the Bluetooth headphone body 50. The Bluetooth headphone body 50 has an ear hook 51. One end of the ear hook 51 is provided with a first MMCX plug 52 to be connected to the MMCX socket 30. The first MMCX plug 52 is pluggable and fitted in the MMCX socket 30. In addition, a Bluetooth control module, a main control module and a power supply module are provided in the Bluetooth headphone body 50. The power supply module is electrically connected to the Bluetooth control module and the main control module. In the first embodiment, the Bluetooth headphone is a binaural Bluetooth headphone, having two Bluetooth headphone bodies and two in-ear headphones. It may be a monaural Bluetooth headphone depending on the actual situation.

As shown in FIG. 5, in a second embodiment, the detachable headphone assembly comprises two said in-ear headphones each having the MMCX socket 30 and two first headphone cables 60 connected to the two in-ear headphones respectively. One end of each of the first headphone cables 60 is provided with a second MMCX plug 61 to be connected to the MMCX socket 30. The second MMCX plug 61 is pluggable and fitted in the MMCX socket 30. The other ends of the two first headphone cables 60 are connected to an audio plug 62.

As shown in FIG. 6, in a third embodiment, the detachable headphone assembly comprises two said in-ear headphones each having the MMCX socket 30 and two second headphone cables 70 connected to the two in-ear headphones respectively. One end of each of the second headphone cables 70 is provided with a third MMCX plug 71 to be connected to the MMCX socket 30. The third MMCX plug 71 is pluggable and fitted in the MMCX socket 30. The other ends of the two second headphone cables 70 are connected to a Bluetooth control module 72.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An in-ear headphone having an MMCX (micro-miniature coaxial) socket, comprising a headphone housing and a speaker assembly disposed in the headphone housing, the headphone housing including a first housing and a second housing to be connected with each other; the first housing having a first interface portion extending from one end thereof, the second housing having a second interface portion extending from one end thereof, the first interface portion and the second interface portion jointly forming an interface, the interface being mounted with the MMCX socket used for connection of a pluggable headphone cable, the MMCX socket being connected to the speaker assembly; the first interface portion being provided with positioning protrusions, the MMCX socket having a base and a plug-in terminal disposed in the base, the base having positioning grooves thereon; the MMCX socket being installed in the first interface portion, the positioning grooves being mated with the positioning protrusions respectively so that the MMCX socket is positioned in the first interface portion, the second interface portion being assembled to the first interface portion for positioning the MMCX socket;

wherein the first housing is provided with a first limiting portion for limiting an inner end of the MMCX socket; and an inner end of the base is limited by the first limiting portion;

wherein the second interface portion includes a second semi-annular portion, the second semi-annular portion has a second semi-circular mounting trough therein, the first semi-annular portion and the second semi-annular portion are attached to each other, the first semi-circular mounting trough and the second semi-circular mounting trough are assembled with each other to form the interface; an end surface of the second semi-annular portion is inwardly recessed with a first positioning step, an outer surface of the base is correspondingly provided with a second positioning step, the second positioning step extends inwardly beyond a rear end of the base, the second positioning step is formed with the positioning grooves, and the first positioning step is configured to match with the second positioning step; and wherein the second housing is provided with a second limiting portion for limiting an inner end of the MMCX socket; an inner end of the base is limited by the second limiting portion, and the second limiting portion is disposed corresponding to the first limiting portion.

2. The in-ear headphone having the MMCX socket as claimed in claim 1, wherein the first interface portion includes a first semi-annular portion, the first semi-annular portion has a first semi-circular mounting trough therein, the positioning protrusions are disposed on two opposite sidewalls in the first semi-annular portion and extend out of an end surface of the first semi-annular portion; and the positioning grooves are disposed at two sides of the base, respectively.

3. The in-ear headphone having the MMCX socket as claimed in claim 1, wherein the first housing is provided with a first splicing surface for welding, the second housing is provided with a second splicing surface for welding, the first splicing surface and the second splicing surface are spliced to each other by laser welding, and outer surfaces of the first housing and the second housing are formed with a polishing area for a laser welding mark.

4. The in-ear headphone having the MMCX socket as claimed in claim 1, wherein the first housing and the second housing are stainless steel housings.

5. A detachable headphone assembly, comprising a Bluetooth headphone body and the in-ear headphone having the MMCX socket as claimed in claim 1, the in-ear headphone being connected to the Bluetooth headphone body; the Bluetooth headphone body having an ear hook, one end of the ear hook being provided with a first MMCX plug to be connected to the MMCX socket, the first MMCX plug being pluggable and fitted in the MMCX socket.

6. A detachable headphone assembly, comprising two said in-ear headphones each having the MMCX socket as claimed in claim 1 and two first headphone cables connected to the two in-ear headphones respectively; a first end of each of the first headphone cables being provided with a second MMCX plug to be connected to the MMCX socket, the second MMCX plug being pluggable and fitted in the MMCX socket, and second ends of the first headphone cables being connected to an audio plug.

7. A detachable headphone assembly, comprising two said in-ear headphones each having the MMCX socket as claimed in claim 1 and two second headphone cables connected to the two in-ear headphones respectively, a first end of each of the second headphone cables being provided with a third MMCX plug to be connected to the MMCX socket, the third MMCX plug being pluggable and fitted in the MMCX socket, and second ends of the second headphone cables being connected to a Bluetooth control module.

* * * * *